US009132843B2

(12) United States Patent
Otsubo et al.

(10) Patent No.: US 9,132,843 B2
(45) Date of Patent: Sep. 15, 2015

(54) COMMUNICATION SYSTEM FOR USE WITH TRAIN CONSIST

(71) Applicant: Electro-Motive Diesel, Inc., Lagrange (IL)

(72) Inventors: Tom Otsubo, Oak Grove, MO (US); Dennis John Melas, Chicago, IL (US); Gregory Raymond Kupiec, Lemont, IL (US); Mark Alan Fanara, Blue Springs, MO (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 50 days.

(21) Appl. No.: 13/903,367

(22) Filed: May 28, 2013

(65) Prior Publication Data

US 2014/0358336 A1 Dec. 4, 2014

(51) Int. Cl.

| | |
|---|---|
| ***G05D 1/00*** | (2006.01) |
| ***B61C 17/12*** | (2006.01) |
| ***B61L 15/00*** | (2006.01) |
| *B61C 3/00* | (2006.01) |

(52) U.S. Cl.

CPC ..... *B61C 17/12* (2013.01); *B61L 15/0072* (2013.01); *B61C 3/00* (2013.01); *B61L 2201/00* (2013.01)

(58) Field of Classification Search

CPC ..... Y02T 30/10; B61C 15/102; B61C 17/12; B61C 3/00; B61C 5/00; B61C 7/04; B60L 2200/26

USPC ..... 701/19, 20, 115; 246/5, 187 C, 186; 105/62.1

See application file for complete search history.

(56) References Cited

U.S. PATENT DOCUMENTS

| | | | | |
|---|---|---|---|---|
| 6,408,766 | B1 | 6/2002 | McLaughlin et al. | |
| 7,021,588 | B2 | 4/2006 | Hess, Jr. et al. | |
| 7,349,797 | B2 * | 3/2008 | Donnelly et al. | 701/115 |
| 2008/0281477 | A1 | 11/2008 | Hawthorne et al. | |
| 2010/0019103 | A1 | 1/2010 | Kane et al. | |
| 2010/0241295 | A1 | 9/2010 | Cooper et al. | |
| 2011/0270475 | A1 | 11/2011 | Brand et al. | |
| 2012/0136514 | A1 | 5/2012 | Noffsinger et al. | |
| 2012/0316707 | A1 * | 12/2012 | Kraeling et al. | 701/19 |
| 2013/0261842 | A1 * | 10/2013 | Cooper et al. | 701/1 |

OTHER PUBLICATIONS

U.S. Appl. No. 13/563,220 by Aaron Gamache Foege et al., filed Jul. 31, 2012 entitled "Fuel Distribution System for Multi-Locomotive Consist".

U.S. Appl. No. 13/690,239 by James Robert Luecke et al., filed Nov. 30, 2012 entitled "Data Communication Systems and Methods for -Locomotive Consists".

U.S. Patent Application by Tom Otsubo et al., filed on May 24, 2013 entitled "Locomotive/Tender Car Communication System".

* cited by examiner

*Primary Examiner* — Gertrude Arthur Jeanglaude

(74) *Attorney, Agent, or Firm* — Finnegan, Henderson, Farabow, Garrett & Dunner, LLP

(57) ABSTRACT

The disclosure is directed to a communication method for use with a train consist having a locomotive and a tender car. The communication method may include transmitting between the locomotive and the tender car operational data captured by network components located onboard at least one of the locomotive and the tender car. The method may further include selectively adjusting an operation of at least one of the locomotive and the tender car based on the data.

8 Claims, 2 Drawing Sheets

COMMUNICATION SYSTEM FOR USE WITH TRAIN CONSIST

TECHNICAL FIELD

The present disclosure relates generally to a communication method and, more particularly, to a communication method for use with a train consist.

BACKGROUND

A consist includes one or more locomotives, and in some instances a tender car, that are coupled together to produce motive power for a train of rail vehicles. The locomotives each include one or more engines, which combust fuel to produce mechanical power. The engine(s) of each locomotive can be supplied with liquid fuel (e.g., diesel fuel) from an onboard tank, gaseous fuel (e.g., natural gas) from the tender car, or a blend of the liquid and gaseous fuels. The mechanical power produced by the combustion process is directed through a generator and used to generate electricity. The electricity is then routed to traction motors of the locomotives, thereby generating torque that propels the train. The locomotives can be connected together at the front of the train or separated and located at different positions along the train. For example, individual locomotives can be located at either end of the tender car, and the consist can be positioned at the front, middle, or end of the train. In some instances, more than one consist may be included within a single train.

Because the locomotives of a consist must cooperate to propel the train, communication between the locomotives and/or between the locomotives and the tender car can be important. Historically, this communication has been facilitated through the use of an MU (Multi-Unit) cable that extends along the length of the consist. An MU cable is comprised of many different wires, each capable of carrying a discrete signal used to regulate a different aspect of consist operation. For example, a lead locomotive generates current within a particular one of the wires to indicate a power level setting requested by the train operator. When this wire is energized, the engines of all locomotives are caused to operate at a specific throttle value. In another example, when one locomotive experiences a fault condition, another of the wires is energized to alert the other locomotives of the condition's existence.

Although acceptable in some applications, the information traditionally transmitted via the MU cable may be insufficient in other application. For example, during the fault condition described above, it can be important to know a severity and/or cause of the fault condition so that an appropriate response to the fault condition can be implemented in an effective and efficient manner. Additionally, as consist configurations become more complex, for example during multi-unit blended fuel operations (i.e., operations where gaseous fuel from the tender car is simultaneously supplied to multiple locomotives and mixed with diesel fuel at different rates), control of the locomotives and/or the tender car may require a greater amount of cooperation and/or more complex communication than can be provided via the MU cable.

One attempt to address the above-described problems is disclosed in U.S. Patent Publication 2010/0241295 of Cooper et al. that published on Sep. 23, 2010 ("the '295 publication"). Specifically, the '295 publication discloses a method of communicating a lead locomotive and one or more trail locomotives with each other via an MU cable. Each locomotive includes a computer unit, which, along with the MU cable, forms an Ethernet network in the train. With this configuration, network data can be transmitted from the computer unit in the lead locomotive to the computer units in the trail locomotives. The network data includes data that is packaged in packet form as data packets and uniquely addressed to particular computer units. The network data can be vehicle sensor data indicative of vehicle health, commodity condition data, temperature data, weight data, and security data. The network data is transmitted orthogonal to conventional non-network (i.e., command) data that is already being transmitted on the MU cable.

While the consist of the '295 publication may have improved communication between locomotives, it may still be less than optimal. In particular, the disclosed method of the '295 patent may not have an effect on control over tender car/locomotive operations.

The methods of the present disclosure solve one or more of the problems set forth above and/or other problems with existing technologies.

SUMMARY

In one aspect, the disclosure is directed to a method of communicating a locomotive with a tender car. The method may include transmitting between the locomotive and the tender car operational data captured by network components located onboard at least one of the locomotive and the tender car. The method may further include selectively adjusting an operation of at least one of the locomotive and the tender car based on the data.

In another aspect, the disclosure is directed to another method of communicating a locomotive with a tender car. This method may include transmitting identification information between the locomotive and the tender car, and making a determination of an incompatibility between the locomotive and the tender car based on the identification information. The method may further include generating an alert based on the determination.

In yet another aspect, the disclosure is directed to still another method of communicating a locomotive with a tender car. This method may include transmitting identification information between the locomotive and the tender car, and making a determination of a discrepancy between a capacity of the locomotive and a capacity of the tender car based on the identification information. The method may further include scaling future operation of at least one of the locomotive and the tender car based on the determination.

DETAILED DESCRIPTION

Figure 1:
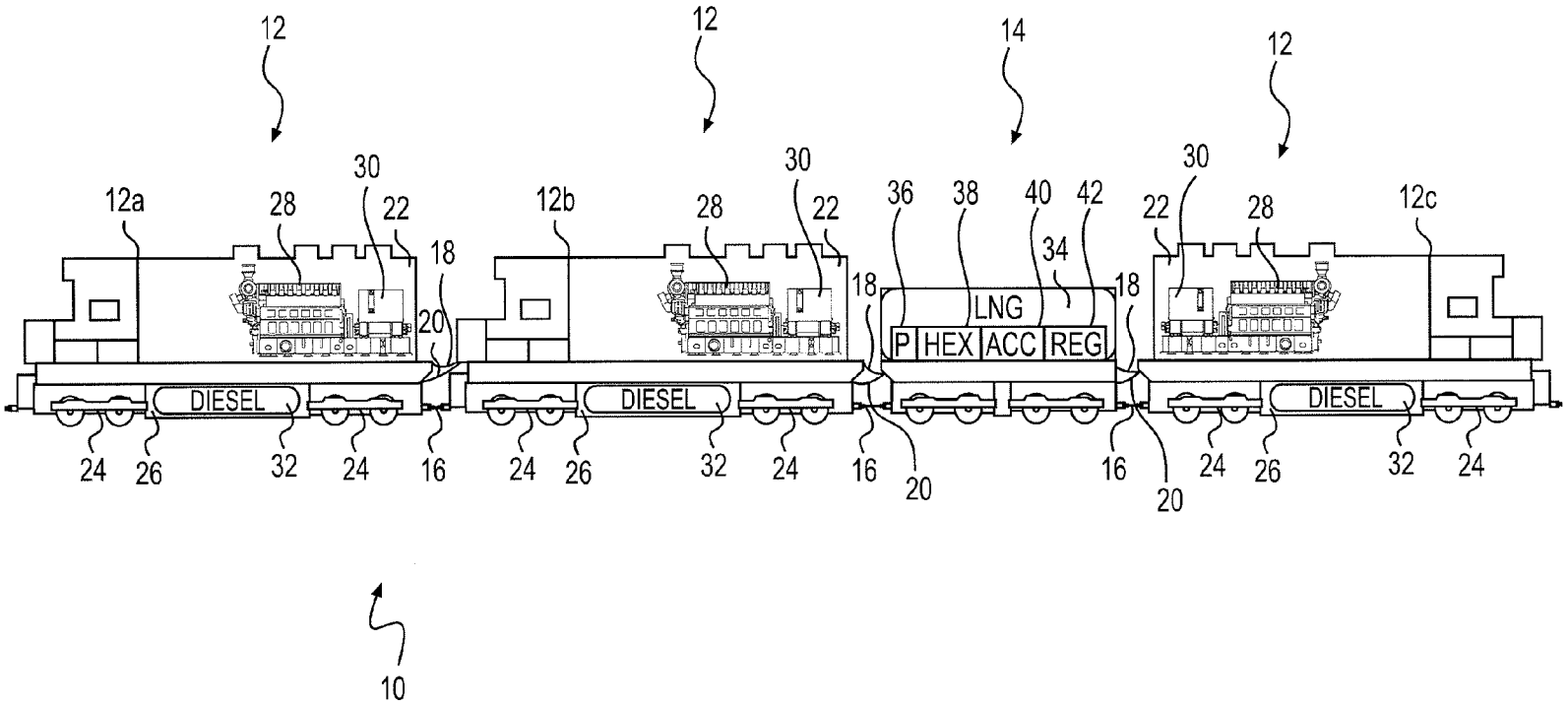
FIG. 1 is a pictorial illustration of an exemplary disclosed consist.

FIG. 1 illustrates an exemplary train consist 10 having one or more locomotives 12 and a tender car 14. In the disclosed embodiment, consist 10 has three different locomotives 12, including a lead locomotive 12*a* located ahead of tender car 14 and two trailing locomotives 12*b*, 12*c* located behind tender car 14. It is contemplated, however, that consist 10 may include any number of locomotives 12 and/or tender cars, and that locomotives 12 may be located in any arrangement relative to tender car(s) 14 and in any orientation (e.g., forward-facing or rear-facing). Consist 10 may be located at the front of a train of other rail vehicles (not shown), within the train of rail vehicles, or at the end of the train of rail vehicles. It is also contemplated that more than one consist 10 may be included within a single train of rail vehicles, if desired, and/or that consist 10 may travel at times without a train of other rail vehicles.

Each locomotive 12 may be connected to an adjacent locomotive 12 and/or tender car 14 in several different ways. For example, locomotives 12 and tender car 14 may be connected to each other via a mechanical coupling 16, one or more fluid couplings 18, and one or more electrical couplings 20. Mechanical coupling 16 may be configured to transmit tractive and braking forces between locomotives 12 and tender car 14. Fluid couplings 18 may be configured to transmit fluids (e.g., fuel, coolant, lubrication, pressurized air, etc.) between locomotives 12 and tender car 14. Electrical couplings 20 may be configured to transmit power and/or data (e.g., data in the form of electrical signals) between locomotives 12 and tender car 14. In one example, electrical couplings 20 include an MU cable configured to transmit conventional command signals and/or electrical power. In another example, electrical couplings 20 include a dedicated data link configured to transmit packets of data (e.g., Ethernet data), as will be discussed in more detail below. In yet another example, the data packets may be transmitted via the MU cable. It is also contemplated that some data may be transmitted between locomotives 12 and tender car 14 via a combination of the MU cable, the dedicated data link, and/or other means (e.g., wirelessly), if desired.

Each locomotive 12 may include a car body 22 supported at opposing ends by a plurality of trucks 24 (e.g., two trucks 24). Each truck 24 may be configured to engage a track (not shown) via a plurality of wheels, and to support a frame 26 of car body 22. Any number of engines 28 may be mounted to frame 26 within car body 22 and drivingly connected to a generator 30 to produce electricity that propels the wheels of each truck 24. Engines 28 may be internal combustion engines configured to combust a mixture of air and fuel. The fuel may include a liquid fuel (e.g., diesel) provided to engines 28 from a tank 32 located onboard each locomotive 12, a gaseous fuel (e.g., natural gas) provided by tender car 14 via fluid couplings 18, and/or a blended mixture of the liquid and gaseous fuels.

Tender car 14, like locomotives 12, may also be equipped with a frame 26 that is supported by two or more trucks 24. Tender car 14 may also include one or more tanks 34 mounted to its frame 26 that are configured to store liquefied gaseous fuel (e.g., liquefied natural gas or LNG). The liquefied gaseous fuel may be gasified and then fed in series or parallel to all locomotives 12 of consist 10 for combustion within engines 28. In the disclosed embodiment, a single insulated tank 34 is used to store the liquefied gaseous fuel at low temperatures, such as below about −160° C. In some embodiments, tank 34 may be integral with frame 26 of tender car 14.

Additional fuel delivery components may be associated with tender car 14 and used to gasify and/or transport the fuel from tender car 14 to locomotives 12. These components may include, among other things, one or more fuel pumps 36, one or more heat exchangers 38, one or more accumulators 40, one or more regulators 42, and associated conduits (not shown) that condition, pressurize or otherwise move fuel, as is known in the art.

Pump(s) 36 may be situated near or within tank 34, and embody, for example, cryogenic pumps, piston pumps, centrifugal pumps, or any other pumps that are known in the industry. Pumps 36 may primarily be powered with electricity supplied via couplings 20 from generators 30 located onboard locomotives 12 (e.g., onboard lead locomotive 12*a*). Additionally or alternatively, pumps 36 may be powered by an electric storage system and/or an onboard auxiliary engine (not shown), if desired. Pumps 36 may pressurize the liquefied gaseous fuel to a desired operating pressure and push the fuel through heat exchanger(s) 38 to accumulator(s) 40. Heat exchanger(s) 38 may provide heat sufficient to gasify the fuel as it moves therethrough. Upon vaporization, the fuel may be transported to and stored within accumulator(s) 42. Although shown as being located onboard only tender car 14, it is contemplated that some or all of accumulator(s) 42 could alternatively be located onboard each locomotive 12. Gaseous fuel may be directed to engines 28 via regulator(s) 42.

Figure 2:
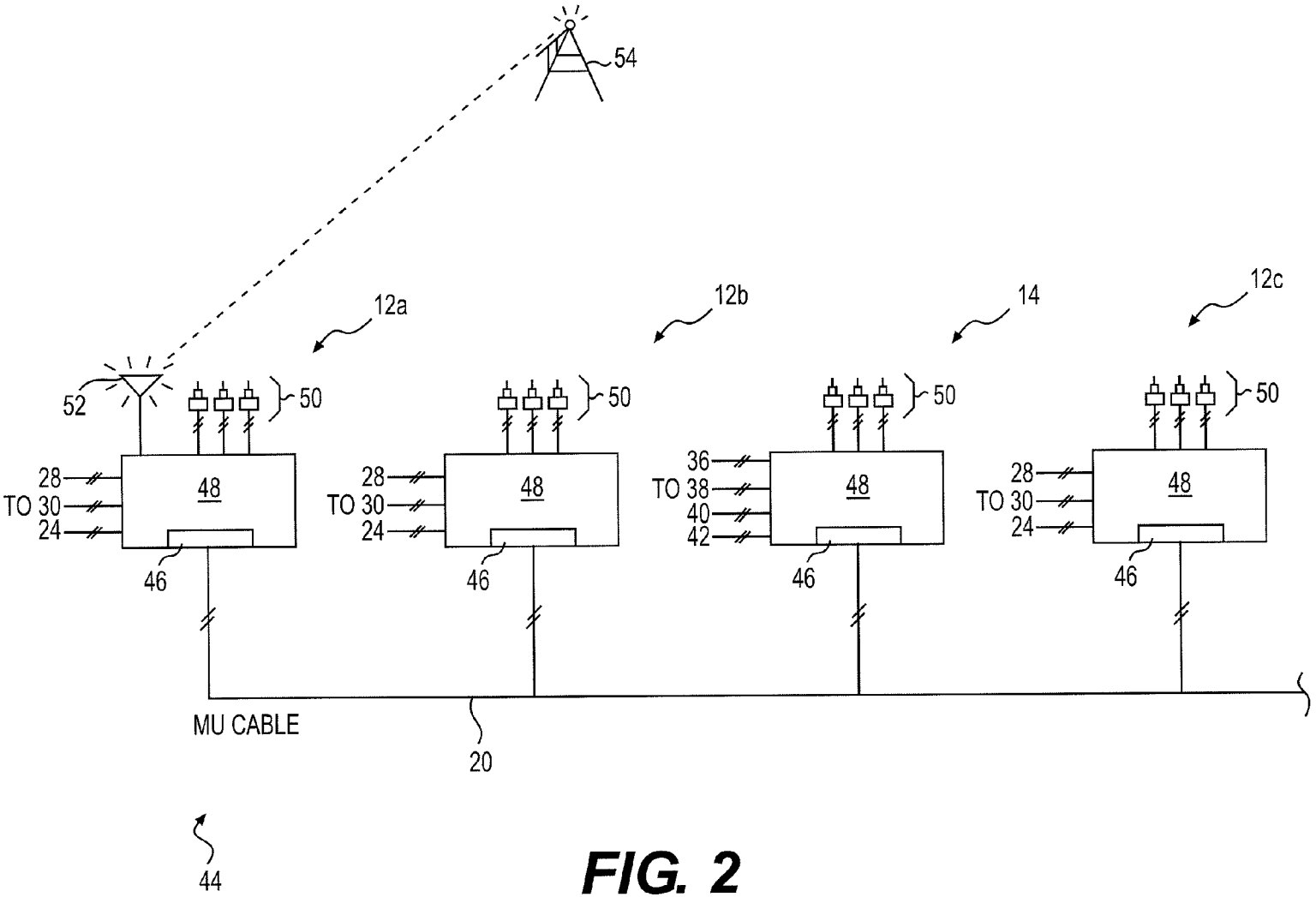
FIG. 2 is a diagrammatic illustration of an exemplary disclosed communication system that may be used in conjunction with the consist of FIG. 1.

As shown in FIG. 2, consist 10 may be equipped with a communication system 44 that facilitates coordinated control of locomotives 12 and tender car 14. Communication system 44 may include, among other things, an access point 46 for each locomotive 12 and for tender car 14. Each access point 46 may be connected to one or more wired and/or wireless networks, and used to communicate command signals and/or data between controllers 48 of each rail vehicle and various other network components (e.g., sensor, valves, pumps, heat exchangers, accumulators, regulators, actuators, etc.) 50 that are used to control locomotives 12 and/or tender car 14. Access points 46 may be connected to each other via electrical couplings 20 (e.g., via the MU cable, via the dedicated data link, and/or wirelessly).

Each access point 46 may include a processor, a router & bridge, an MU modem, input/output (I/O) ports, a storage, a memory, and any other conventional components known in the art. The I/O ports may facilitate communication between the associated access point 46 and one or more of network components 50. Likewise, the MU modem may facilitate communication between different access points 46 connected to each other via electrical couplings 20. The router & bridge may be configured to route data packets between the processor and the I/O ports and/or between the processor and the MU modem. For example, when a particular access point 46 receives data packets from corresponding I/O ports and/or from the MU modem, the router & bridge may route the data packets to the processor.

The processor may include one or more processing devices, such as microprocessors and/or embedded controllers. The storage may include volatile or non-volatile, magnetic, semiconductor, tape, optical, removable, non-removable, or other type of computer-readable medium or computer-readable storage device. The storage may be configured to store programs and/or other information that may be used to implement one or more of the processes discussed below. The memory may include one or more storage devices configured to store information used by the associated access point 46.

Each controller 48 may be configured to control operational aspects of its related rail vehicle. For example, controller 48 of lead locomotive 12*a* may be configured to control operational aspects of its corresponding engine 28, generator 30, traction motors, operator displays, and other associated components. Likewise, the controllers 48 of trail locomotives 12*b* and 12*c* may be configured to control operational aspects of their corresponding engines 28, generators 30, traction motors, operator displays, and other associated components. In some embodiments, controller 48 of lead locomotive may be further configured to control operational aspects of trail locomotives 12*b* and 12*c*, if desired. Controller 48 of tender car 14 may be configured to control operational aspects of pump(s) 36, heat exchanger(s) 38, accumulator(s) 40, regulator(s) 42, and other associated tender car components.

Each controller 48 may embody a single microprocessor or multiple microprocessors that include a means for controlling an operation of the associated rail vehicle based on information obtained from any number of network components 50 and/or communications received via access points 46. Numerous commercially available microprocessors can be configured to perform the functions of controller 48. Controller 48 may include a memory, a secondary storage device, a processor, and any other components for running an application. Various other circuits may be associated with controller 48 such as power supply circuitry, signal conditioning circuitry, solenoid driver circuitry, and other types of circuitry.

The information obtained by a particular controller 48 via access points 46 and/or network components 50 may include performance related data associated with operations of each locomotive 12 and/or tender car 14 ("operational information"). For example, the sensory data could include engine related parameters (e.g., speeds, temperatures, pressures, flow rates, etc.), generator related parameters (e.g., speeds, temperatures, voltages, currents, etc.), operator related parameters (e.g., desired speeds, desired fuel settings, locations, destinations, braking, etc.), liquid fuel related parameters (e.g., temperatures, consumption rates, fuel levels, demand, etc.), gaseous fuel related parameters (e.g., temperatures, supply rates, fuel levels, etc.), and other parameters known in the art. The performance related data may be data sensed via individual sensors of network components 50 and/or data that is calculated based on assumed or measured parameters.

The information obtained by a particular controller 48 via access points 46 and/or network components 50 may also include identification data of the other rail vehicles within the same consist 10. For example, each controller 48 may include stored in its memory the identification of the particular rail vehicle with which controller 48 is associated. The identification data may include, among other things, a type of rail vehicle (e.g., make, model, and unique identification number), physical attributes of the associated rail vehicle (e.g., size, load limit, volume, power output, power requirements, fuel consumption capacity, fuel supply capacity, etc.), and maintenance information (e.g., maintenance history, time until next scheduled maintenance, usage history, etc.). When coupled with other rail vehicles within a particular consist 10, each controller 48 may be configured to communicate the identification data to the other controllers 48 within the same consist 10. Each controller 48, as will be described in more detail below, may be configured to selectively affect operation of its own rail vehicle based on the obtained identification data associated with the other rail vehicles of consist 10.

In some embodiments, controllers 48 may each be configured to affect operation of their associated rail vehicles based on the information obtained via access points 46 and/or network components 50 and one or more maps stored in memory. Each of these maps may include a collection of data in the form of tables, graphs, and/or equations. Some of these operations will be described in more detail in the following section.

In some instances, it may be beneficial to export operational information to an offboard entity 52. In particular, lead locomotive 12*a* (or another rail vehicle of the associated consist 10) may be equipped with a communication device 54 connectable with controller 48. Communication device 54 may be configured to communicate messages wirelessly between controller 48 and offboard entity 52. The wireless communications may include satellite, cellular, infrared, and any other type of wireless communication. Offboard entity 52 may be, for example, service personnel, and the communications may include messages regarding fault conditions, identification of failed components, and/or instructions for the service personnel. It is contemplated that other information may also be transmitted offboard, if desired.

INDUSTRIAL APPLICABILITY

The disclosed communication system may be applicable to any consist having at least one locomotive and a tender car that is coupled with the locomotive. The communication system may enhance cooperation between the locomotive and the tender car by facilitating complex communication of data that affects fuel use and fuel supply. Exemplary operations of communication system 44 will now be described in detail.

As disclosed above, during or after coupling of different rail vehicles within a particular consist 10, controllers 48 of each rail vehicle may begin to communicate with each other via electrical couplings 20. For example, controller 48 of tender car 14 may communicate with each controller 48 of locomotives 12 via the existing MU cable. This communication may include the exchange of identification information. For instance, controller 48 of tender car 14 may provide the other controllers 48 of each locomotive 12 with an identification of tender car 14 as a tender car of a particular make and model. Controller 48 of tender car 14 may additionally communicate a maximum fuel volume, a fuel supply capacity, an electrical power requirement, a maintenance history, and other information to locomotives 12. In some instances, controllers 48 of locomotives 12 may already know some of this information based on the make and model of tender car 14. Likewise, controllers 48 of locomotives 12 may transmit similar information to tender car 14 at this same time.

In some embodiments, controllers 48 of the different rail vehicles may adjust operation of their associated rail vehicles based on the identification information. For example, it may be possible that one or more rail vehicles of particular makes and models are not compatible with each other. And after the exchange of identification information, an alert may be generated indicative of the situation. In another example, it may be possible for a particular locomotive 12 (or group of locomotives 12) to normally demand a fuel supply rate during a particular throttle setting that exceeds an established capacity of tender car 14 to supply fuel. In this situation and based on the identification information, controllers 48 of one or more of locomotives 12 may be configured to selectively scale future fuel supply demands while connected with the particular tender car 14. For the purposes of this disclosure, scaling may be considered a reduction or increase in a demand for fuel from for particular engine 28 according to one or more scale factors stored in memory and associated with particular makes and/or models of tender cars 14. Alternatively, controllers 48 of one or more of locomotives 12 may be configured to selectively use different fuel blend ratios. It may also be possible for controllers 48 of locomotives 12 to reduce a fuel supply load on tender car 14 (or for controller 48 of tender car 14 to reduce a rate of fuel supply to a particular locomotive 12) based on a maintenance history or another identification parameter (e.g., when a particular rail vehicle is nearing a required maintenance interval).

During operation of consist 10, controllers 48 may be configured to further adjust operation of their associated rail vehicles based on performance data communicated between controllers 48 over the MU cable. For example, during a fault condition, different actions can be taken depending on which rail vehicle is generating the fault condition and what the fault condition is. Specifically, it may be possible for tender car 14 to generate fault conditions of different criticality. The fault conditions can be generated manually or automatically based on one or more conditions sensed by network components 50 (e.g., based on a fuel level, a temperature, a pressure, a flow rate, a manually-pressed cutoff switch, etc.). When the fault condition from tender car 14 is a non-critical fault condition, controllers 48 of locomotives 12 may simply log the fault condition without further action being taken. However, when a more serious fault condition is communicated via electrical coupling 20, controllers 48 could alert the train operator, communicate the condition offboard to entity 52, reduce a consist speed and/or torque, adjust the blend ratio of fuels consumed by engines 28 (i.e., reduce or increase consumption of gaseous fuel from tender car 14), cause brakes to be applied, and/or implement other evasive maneuvers. The reverse may also be true, wherein controller 48 of tender car 14 selectively adjusts operation of pump 36, heat exchanger 38, accumulator 40, and/or regulator 42 based on fault conditions from controllers 48 of locomotives 12 (e.g., based on fault conditions that are triggered from sensed speeds, temperatures, pressures, etc. of engines 28, generator 30, and/or associated wheel traction motors).

In some situations, it may be possible to generate the fault conditions based on communications between controller 48 of tender car 14 and controllers 48 of locomotives 12. For example, network components 50 of a particular locomotive 12 may be capable of sensing or otherwise calculating a fuel consumption rate of an associated engine 28 (e.g., based on a measured flow rate, a measured speed of engine 28, a fuel setting, etc.). Likewise, network components 50 of tender car 14 may be capable of sensing or otherwise calculating a rate of fuel supply to the engine 28 (e.g., based on a measured flow rate, a measured speed and/or pressure of pump 36, etc.). This information may then be communicated between rail vehicles via electrical coupling 20 and, based on the information, one or more of controllers 48 may be able to detect a significant difference between the fuel consumption and supply rates that is indicative of a fuel leak. When this occurs, a corresponding fault condition may be triggered causing operational adjustments of one or more of the rail vehicles.

In another example, during a non-fault condition (i.e., during normal operation), controllers 48 may still be configured to adjust operation of their associated rail vehicles based on performance data communicated between controllers 48. For example, operation of locomotives 12 and/or tender car 14 may be adjusted based on the changing level of fuel within tanks 32 of locomotives 12 and/or within tank 34 of tender car 14. There are many reasons for doing so and many ways in which this can be done. Several exemplary situations are provided below.

In a first situation, it may be possible for locomotives 12 to have different amounts of liquid fuel stored onboard within tanks 32 at any given time. For example, tank 32 of lead locomotive may be nearly full of diesel fuel, while tank 32 of trail locomotive 12*b* may be half full, and tank 32 of trail locomotive 12*c* may be one-quarter full. In an ideal situation, for emission purposes, each engine 28 of locomotives 12 should be supplied with about the same blend of diesel fuel and natural gas. However, such operation could cause trail locomotive 12*c* to completely consume its supply of diesel fuel long before the other locomotives 12 consume their supplies. In this situation, it may be better for lead locomotive 12*a* to operate with a higher diesel fuel blend and for trail locomotive 12*c* to operate with a higher natural gas blend, such that all locomotives 12 can operate for an extended period of time. Accordingly, based on fuel levels sensed by network components 50 that are communicated between controllers 48 via access points 46 and electrical coupling 20 (e.g., via the MU cable), each controller 48 may selectively adjust the operation of its own associated rail vehicle. The blend rate of fuel may be adjusted by changing an amount of diesel fuel supplied to each engine 28 via control over onboard fuel supply components and/or by changing an amount of natural gas provided to each engine 28 from tender car 14 via control over pump 36, heat exchanger 38, accumulator 40, and/or regulator 42.

In a second and related situation, the amount of natural gas stored within tank 34 of tender car 14 relative to the amounts of diesel fuel contained within tanks 32 onboard locomotives 12 may be insufficient for the expected duration of an intended trip at a desired fuel blend ratio. After communicating fuel level information between locomotives 12 and tender car 14, one or more of controllers 48 may determine the need to adjust the fuel blend such that the desired destination may be reached with the available fuel.

In a third situation, it may be more efficient for a locomotive 12 located immediately adjacent to tender car 14 (e.g., trail locomotive 12*b*) to run at a higher natural gas blend than for a locomotive 12 located further away from tender car 14 (e.g., lead locomotive 12*a*). The improved efficiency may be something that is sensed via network components 50, calculated by one or more of controllers 48, and/or simply known based on past experience. Regardless of the way in which the improved efficiency is determined, any one or all of controllers 48 may be configured to selectively adjust the blend rates of fuel supplied to any one or more of engines 28.

In a fourth situation, it may be better for the engines 28 of particular locomotives 12 to be loaded to a higher or lower degree than other engines 28. For example, a particular engine 28 may operate more efficiently when under a heavier load, as compared to a different engine 28. Similarly, a particular engine 28 may operate at a more desirable temperature under a given load. Other operational differences may also exist, and these communicated differences may be sensed via network components 50, calculated by controllers 48, or simply known based on past experience, and then communicated between controllers 48. And based on any of these differences, it may be desirable to selectively direct more or less natural gas from tender car 14 to a particular engine 28 of a particular locomotive 12.

In a fifth situation, the demand for natural gas by a particular locomotive 12 may simply change during a single trip and, unless the changing demand is communicated to tender car 14, conditions of tender car 14 may not be appropriate to comply with the change in demand. Specifically, when controller 48 of a particular locomotive 12 communicates a change in demand for natural gas to controller 48 of tender car 14, controller 48 of tender car 14 may respond by adjusting operation of its associated supply components. For example, controller 48 of tender car 14 may adjust operation of pump 36, heat exchanger 38, accumulator 40, and/or regulator 42 based on the performance information from locomotives 12 such that tender car 14 can supply natural gas at the demanded level. It is contemplated that, in some instances, the change in demand may be anticipated and communicated to controller 48 of tender car 14 in advance such that tender car 14 is immediately capable of supplying natural gas at the higher or lower rate when the new demand is received. The change in demand may be anticipated based on known changes in terrain, known restrictions on train speed at particular geographic locations, and other known factors.

In a sixth and related situation, communication between tender car 14 and locomotives 12 may have an effect on when locomotives 12 change their demand for natural gas. For example, it may be possible for controllers 48 of locomotives 12 to request a higher or lower supply rate of natural gas, without yet commanding their associated engines 28 to operate any differently. In response to the requested change in supply rate, controller 48 of tender car 14 may adjust operation of pump 36, heat exchanger 38, accumulator 40, and/or regulator 42 in the manner described above. After making these adjustments, controller 48 of tender car 14 may then inform controllers 48 of locomotives 12 that tender car 14 is ready to supply natural gas at the higher or lower rate. Controllers 48 of locomotives 12 may be configured to only then command engines 28 to operate differently.

In a seventh situation, it may be possible for a particular locomotive controller 48 to request a supply of natural gas from tender car 14 at a rate that exceeds the capability of its associated engine 28 to consume the natural gas. For example, based on pressures, temperatures, speeds, or other conditions sensed by network components 50 from onboard the particular locomotive 12, controller 48 of tender car 14 may be able to determine that the requested supply rate of fuel is too much. In this situation, controller 48 of tender car 14 may be able to selectively reduce the supply rate. Similarly, it may be possible for a particular locomotive controller 48 to request a supply of natural gas from tender car 14 at a rate that exceeds the immediate capability of tender car 14 to supply the fuel. In this situation, controller 48 of tender car 14 may be able to request that the demand rate be temporarily reduced until tender car 14 is capable of increasing its supply rate.

The disclosed communication system may improve control over tender car/locomotive operations. Specifically, the enhance ability to communicate identification and operational information between tender car 14 and locomotives 12 may allow consist 10 to operate more efficiently and more responsively. That is, tender car 14 may be more capable of supplying gaseous fuel to locomotives 12 in a manner and at a timing most beneficial to locomotives 12. At the same time, locomotives 12 may be more capable of adjusting their own operations to accommodate current operations and/or limitations of tender car 14. As a result, consist 10 may be have improved performance.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A method of communicating a locomotive with a tender car, comprising:

transmitting between the locomotive and the tender car operational data captured by network components located onboard at least one of the locomotive and the tender car; and selectively adjusting, via a controller having a processor, an operation of at least one of the locomotive and the tender car based on the data;

wherein the operational data includes operational data captured by network components located onboard both of the locomotive and the tender car; and wherein the operational data includes a level of liquid fuel stored onboard the first locomotive being different than a level of liquid fuel stored onboard the second locomotive;

wherein selectively adjusting an operation includes selectively adjusting operation of an engine located onboard the locomotive; wherein;

the locomotive is a first locomotive;

the engine is a first engine; and transmitting operational data includes transmitting operational data between the first locomotive, a second locomotive, and the tender car; and selectively adjusting the operation includes selectively adjusting an operation of the first engine different than an operation of a second engine located onboard the second locomotive; and wherein selectively adjusting the operation includes selectively adjusting a supply rate of gaseous fuel from the tender car to the first locomotive different than a supply rate of gaseous fuel from the tender car to the second locomotive based on the different levels of liquid fuel stored onboard the first and second locomotives.

2. The method of claim 1, wherein:

the method further includes determining a first distance between the first locomotive and the tender car and a second distance between the second locomotive and the tender car; and selectively adjusting an operation includes selectively adjusting a supply of gaseous fuel from the tender car to the first and second engines differently based on the first and second distance.

3. The method of claim 1, wherein:

the method further includes determining a difference in operational performance between the first and second engines; and selectively adjusting an operation includes selectively adjusting a supply of gaseous fuel from the tender car to the first and second engines differently based on the difference in operational performance.

4. The method of claim 3, wherein the difference in operational performance includes a difference in at least one of efficiency and temperature.

5. The method of claim 1, further including determining a fault condition based on the operational data, wherein selectively adjusting an operation includes selectively adjusting the operation only when the fault condition is determined to be critical.

6. The method of claim 5, further including communicating, via a communication device connectable with a controller equipped on at least one of the first locomotive, the second locomotive, and the tender car the fault condition to an off-board entity.

7. A method of communicating a locomotive with a tender car, comprising:

transmitting between the locomotive and the tender car operational data captured by network components located onboard at least one of the locomotive and the tender car; and selectively adjusting, via a controller having a processor, an operation of at least one of the locomotive and the tender car based on the data;

wherein the operational data includes operational data captured by network components located onboard both of the locomotive and the tender car; and wherein the operational data includes at least one of a speed, a load, a temperature, a flow rate, a pressure, a voltage, a current, a desired fuel setting, braking data, a fuel supply rate, a fuel consumption rate, a change in demand for gaseous fuel, a fuel level of the at least one of the locomotive and the tender car, a level of liquid fuel stored onboard the first locomotive being different than a level of liquid fuel stored onboard the second locomotive, a fuel consumption rate of the locomotive and a fuel supply rate of the tender car, and a level of liquid fuel stored onboard the locomotive and a level of gaseous fuel stored onboard the tender car;

wherein selectively adjusting an operation includes selectively adjusting operation of a least one of a pump, a heat exchanger, an accumulator, and a regulator located onboard the tender car; and wherein selectively adjusting operation includes selectively adjusting operation of at least one of a rate of fuel supply to an engine located onboard the locomotive and a fuel blend ratio.

8. A method of communicating a locomotive with a tender car, comprising:

transmitting between the locomotive and the tender car operational data captured by network components located onboard at least one of the locomotive and the tender car; and selectively adjusting, via a controller having a processor, an operation of at least one of the locomotive and the tender car based on the data;

wherein the operational data includes operational data captured by network components located onboard both of the locomotive and the tender car; and wherein the operational data includes a fuel consumption rate of the locomotive and a fuel supply rate of the tender car;

the method further includes determining fuel leakage based on a difference between the fuel consumption and supply rates; and selectively adjusting includes selectively adjusting the operation of at least one of the locomotive and the tender car based on the fuel leakage.

* * * * *